US011627789B2

(12) United States Patent
Wood et al.

(10) Patent No.: US 11,627,789 B2
(45) Date of Patent: Apr. 18, 2023

(54) STORAGE PANEL WITH RECONFIGURABLE STRAP ARRAY

(71) Applicant: A Wood Products LLC, Poway, CA (US)

(72) Inventors: Adam Wood, Poway, CA (US); Kevin Klemmt, Seattle, WA (US)

(73) Assignee: A WOOD PRODUCTS LLC, Poway, CA (US)

( * ) Notice: Subject to any disclaimer, the term of this patent is extended or adjusted under 35 U.S.C. 154(b) by 0 days.

(21) Appl. No.: 17/327,542

(22) Filed: May 21, 2021

(65) Prior Publication Data

US 2022/0369782 A1 Nov. 24, 2022

(51) Int. Cl.

| | |
|---|---|
| ***A45C 13/30*** | (2006.01) |
| ***A45C 13/00*** | (2006.01) |
| ***A45C 13/10*** | (2006.01) |

(52) U.S. Cl.

CPC ..... *A45C 13/30* (2013.01); *A45C 13/001* (2013.01); *A45C 2013/1015* (2013.01); *A45C 2013/306* (2013.01)

(58) Field of Classification Search

CPC ..... A45C 13/30; A45C 13/001; A45C 2013/1015; A45C 2013/306

See application file for complete search history.

(56) References Cited

U.S. PATENT DOCUMENTS

| | | | | |
|---|---|---|---|---|
| 4,523,702 A | | 6/1985 | Viio | |
| 5,370,288 A | * | 12/1994 | Field | A45C 13/02 224/256 |
| 5,423,404 A | * | 6/1995 | Shaw | B25H 3/00 190/102 |
| 5,622,346 A | * | 4/1997 | Story, Jr. | A45F 5/02 224/675 |
| 6,446,852 B1 | | 9/2002 | Sorensen et al. | |
| 9,033,384 B2 | | 5/2015 | Potter et al. | |
| 9,861,184 B2 | * | 1/2018 | VanHeusen | F41C 33/0209 |
| 11,033,095 B1 | * | 6/2021 | VanHeusen | A45F 5/00 |
| 2013/0199952 A1 | * | 8/2013 | Kinskey | B25H 3/00 206/372 |

(Continued)

FOREIGN PATENT DOCUMENTS

| | | |
|---|---|---|
| DE | 200 07 255 U1 | 9/2000 |
| DE | 20315144 U1 | 12/2003 |
| FR | 2555090 A1 | 5/1985 |

OTHER PUBLICATIONS

International Search Report and Written Opinion of the International Searching Authority completed Feb. 11, 2022, in International Patent Application No. PCT/US21/60795, 10 pages.

*Primary Examiner* — Derek J Battisti

(74) *Attorney, Agent, or Firm* — Lowe Graham Jones PLLC

(57) ABSTRACT

Fastening patches with fastening material (VELCRO, 3M DUAL LOCK) on both surfaces each include a column with outwardly extending tabs. Fastening patches secure to a backing layer and the tabs of fastening patches may secure to one another to form loops for securing items. The backing layer may include fastening material for securing to an inner surface of luggage. The arrangement of the tabs may correspond to the MOLLE or PALS standard. Fastening patches may include smaller anchor tabs at the top and bottom of the column and be secured to luggage without stitching.

20 Claims, 12 Drawing Sheets

(56) References Cited

U.S. PATENT DOCUMENTS

| | | | | |
|---|---|---|---|---|
| 2013/0270206 | A1 | 10/2013 | Peck | |
| 2017/0238667 | A1 | 8/2017 | Dubois et al. | |
| 2018/0266456 | A1* | 9/2018 | Bandlow | F41C 33/0236 |
| 2019/0281938 | A1 | 9/2019 | Eaton | |

* cited by examiner

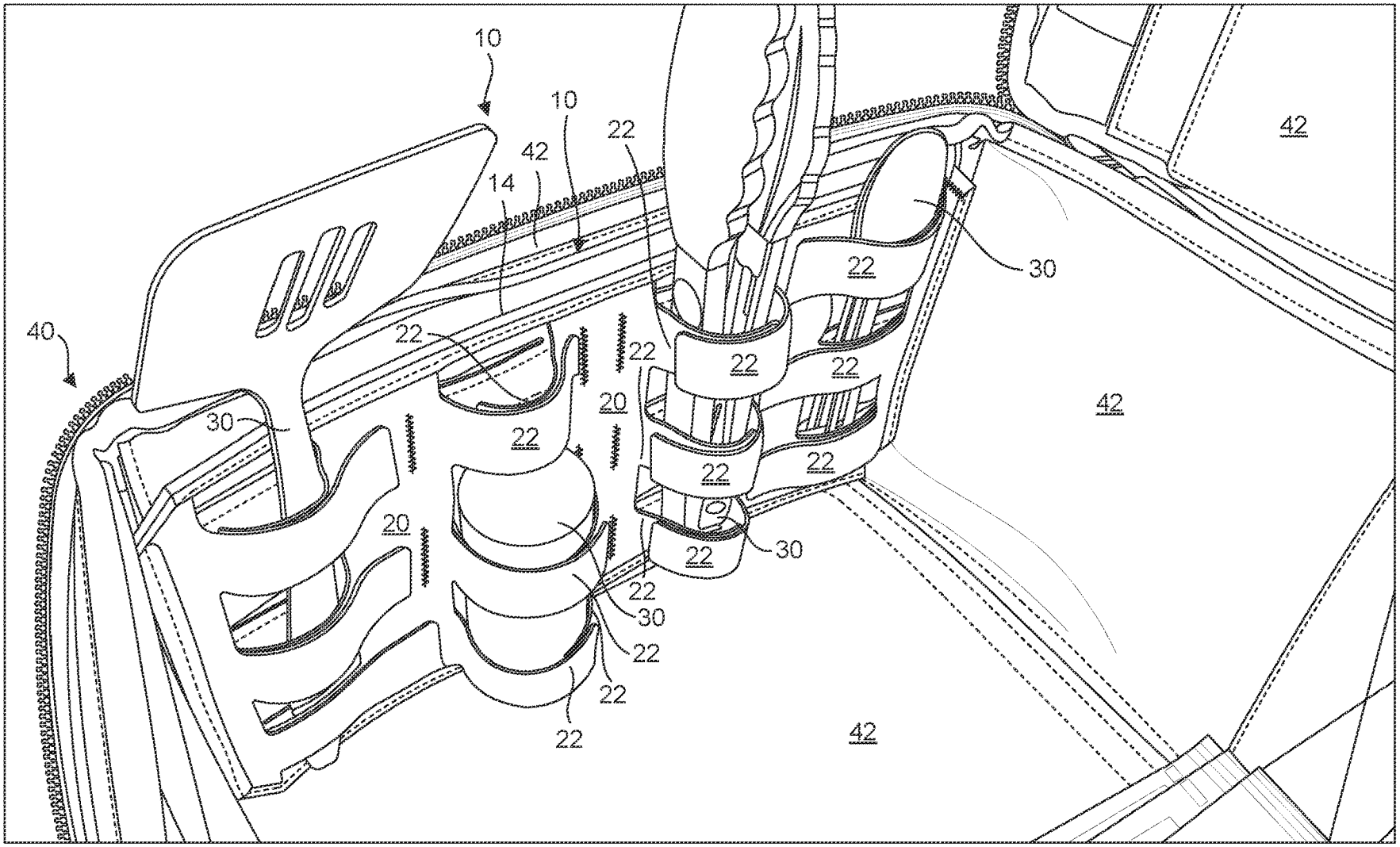
42
42
42
30
22
22
22

STORAGE PANEL WITH RECONFIGURABLE STRAP ARRAY

FIELD OF THE INVENTION

This application relates to storage for items and, more particularly to multi-configurable straps for securing items.

BACKGROUND OF THE INVENTION

A wide variety of luggage and storage containers are available for use by travelers. Luggage items are available in many sizes and may even have features for a particular application. However, no matter how many luggage items are available, each user may still have unique needs.

It would therefore be an advancement in the art to provide greater customization for users of luggage and other storage containers.

SUMMARY OF THE INVENTION

In one aspect of the invention, a storage system includes one or more fastening patches each comprising a sheet of material having a first surface and a second surface opposite the first surface. The first surface has a first fastening material and the second surface has a second fastening material configured to selectively secure to the first fastening material. Each fastening patch defines a first direction and a second direction perpendicular to the first direction. Each fastening patch may include a column having a long dimension substantially parallel to the first direction. Each fastening patch may include tabs extending outwardly from the column in the second direction by an amount at least as great as a width of the column in the second direction.

In some embodiments, the one or more fastening patches include at least three fastening patches and the tabs of a first fastening patch of the three or more fastening patches include first tabs extending outwardly from a first edge of the column of the first fastening patch; and second tabs extending outwardly from a second edge of the column of the second fastening patch, and each aligned with one of the first tabs in the first direction. The tabs of two second fastening patches of the three or more fastening patches may each include third tabs extending outwardly from only a first edge of the column of each second fastening patch.

The storage system may include a backing layer. The three or more fastening patches may be secured to the backing layer having the columns thereof substantially parallel to one another and positioned such that the tabs of each fastening patch of the three or more fastening patches can be connected to the tabs of one or two other fastening patches of the three or more fastening patches.

In some embodiments, the one or more first fastening patches are secured to the backing layer between the two second fastening patches. The three or more fastening patches may be secured to the backing layer by stitching that is offset inwardly from first and second edges of the columns of the one or more first fastening patches and the first edges of the two second fastening patches. The stitching may include bar tacks that are offset from one another along the first direction and are not positioned between the tabs of the three or more fastening patches along the first direction.

Lengths of the first and second tabs may be greater than a separation between the columns of the three or more fastening patches. Positions of the tabs on the backing layer may conform to either of the modular lightweight load-carrying equipment (MOLLE) standard and the pouch attachment ladder system (PALS) standard.

The three or more fastening patches may be secured to a first side of the backing panel and third fastening material may be secured to a second side of the backing panel opposite the first side.

The first fastening material and the second fastening material may be either of (a) part of a hook-and-loop fastening system or (b) 3M DUAL LOCK fastening material.

The tabs of each fastening patch of the one or more fastening patches may be first tabs. Each fastening patch of the one or more fastening patches may include upper anchor tabs extending outwardly from the column in the second direction and lower anchor tabs extending outwardly from the column having the first tabs positioned between the upper anchor tabs and the lower anchor tabs along the first direction. The separation between adjacent tabs of the first tabs, upper anchor tabs, and lower anchor tabs along the first direction may be between 1 and 5 mm. The upper anchor tabs and lower anchor tabs may be smaller than the first anchor tabs in one or both of the first direction and the second direction. The upper anchor tabs and lower anchor tabs may be smaller than the first anchor tabs in both of the first direction and the second direction.

A method may include connecting a first tab of the tabs of the one or more fastening patches to a second tab of the tabs of the one or more fastening patches to form a loop around an item to secure the item in place.

BRIEF DESCRIPTION OF THE DRAWINGS

Preferred and alternative examples of the present invention are described in detail below with reference to the following drawings:

FIG. 5 is an isometric view of the storage apparatus within an item of luggage in accordance with an embodiment of the present invention;

DETAILED DESCRIPTION OF THE PREFERRED EMBODIMENTS

Figure 1A:
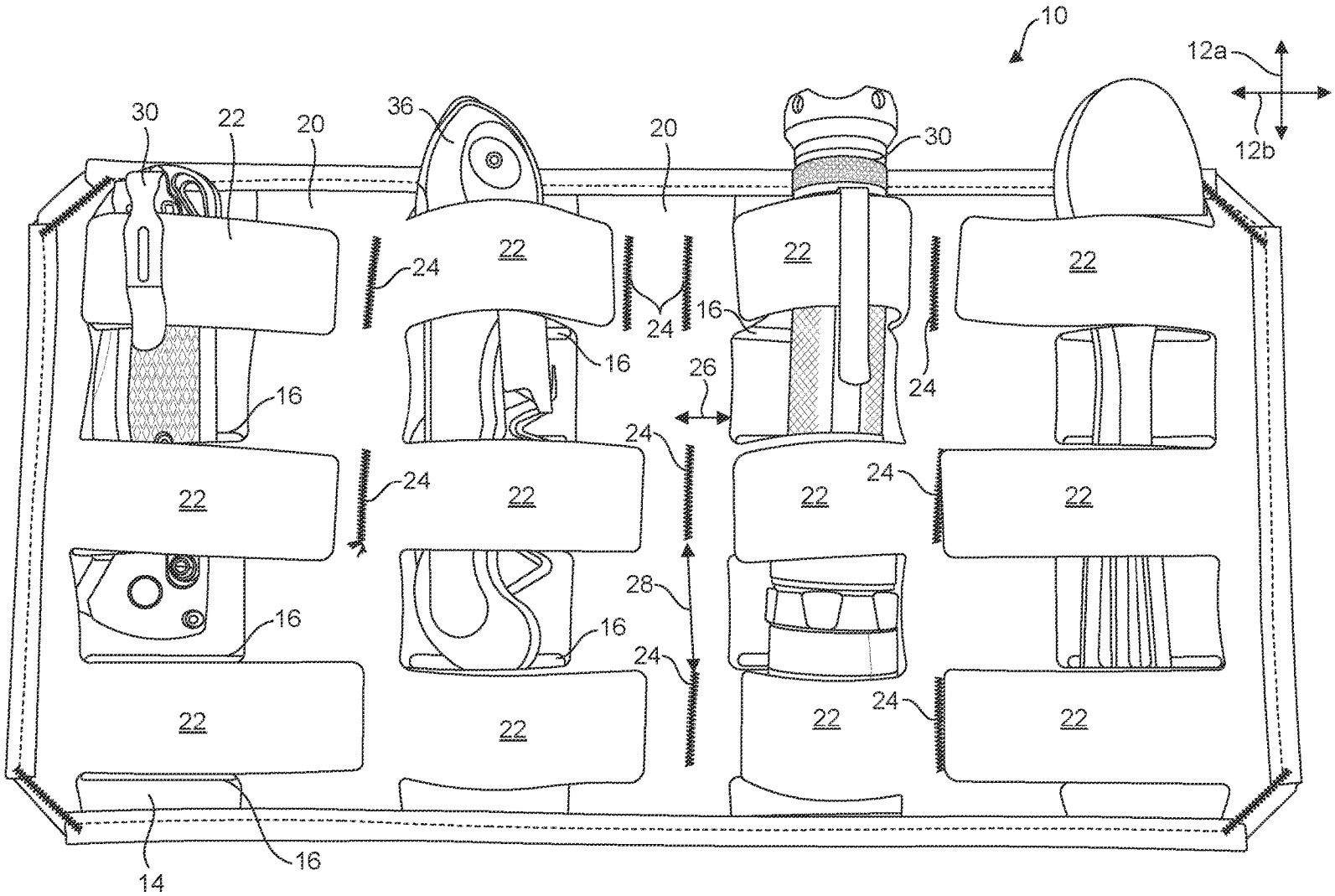
FIG. 1A is a top view of a storage apparatus with in accordance with an embodiment of the present invention.
Figure 1B:
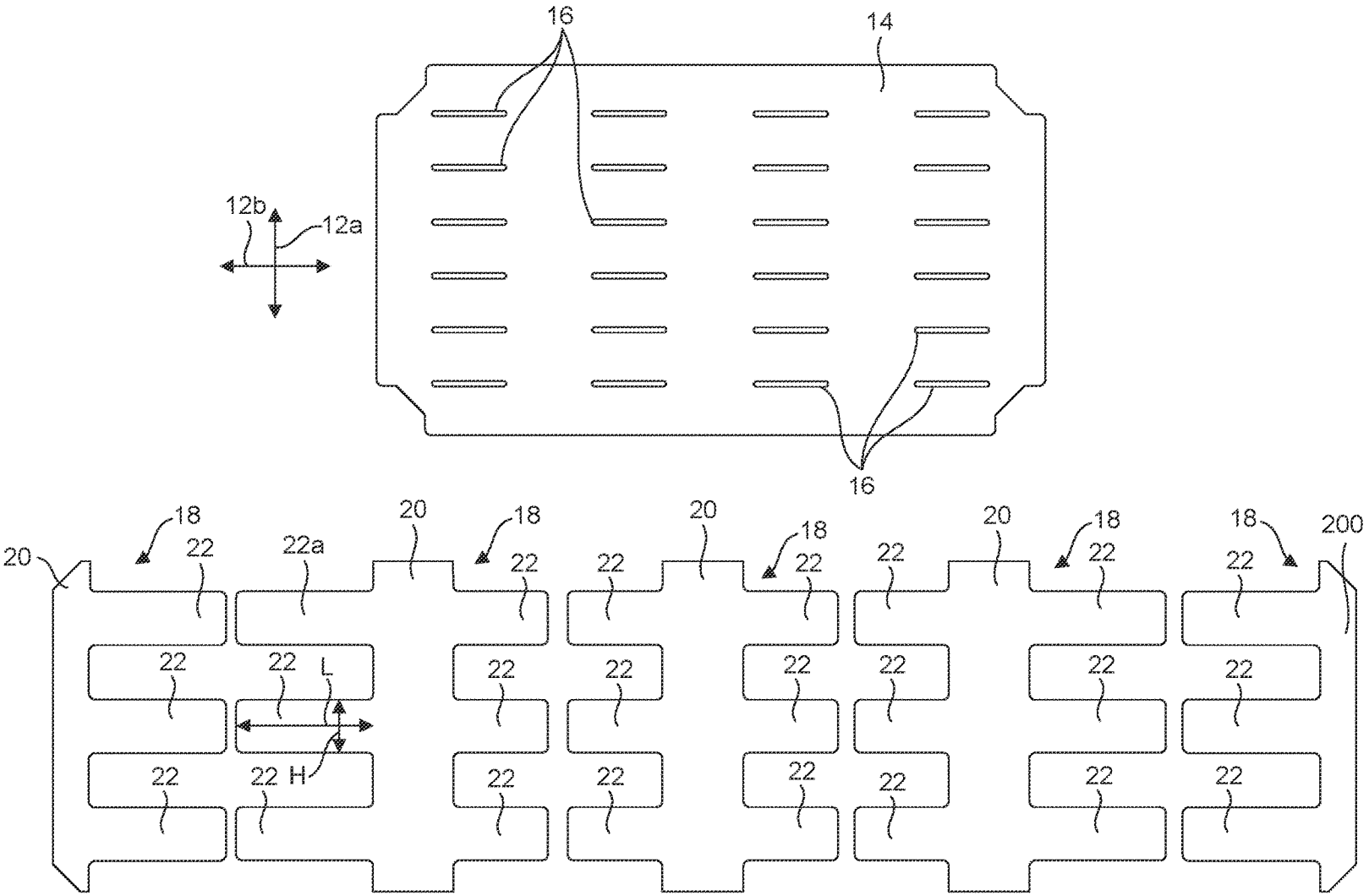
FIG. 1B is a top view of a backing panel and fastening patches for a storage apparatus in accordance with an embodiment of the present invention.

Referring to FIGS. 1A and 1B, a storage apparatus 10 may be understood with respect to a vertical direction 12*a* and a horizontal direction 12*b* that is perpendicular to the vertical direction 12*a*. The directions 12*a*, 12*b* are used to show relative orientation but do not necessarily correspond to the orientation of the apparatus 10 during use.

The apparatus 10 includes a backing panel 14. The backing panel 14 in some embodiments is somewhat rigid, though flexible implementations may also be used. The backing panel 14 may be made of two layers of material, such as layers of nylon stitched or fused to one another. The backing panel 14 may include a core layer made of plastic, metal, wood, or composite material. The core layer may be covered with fabric, such as a nylon fabric on one or both sides.

Figure 1C:
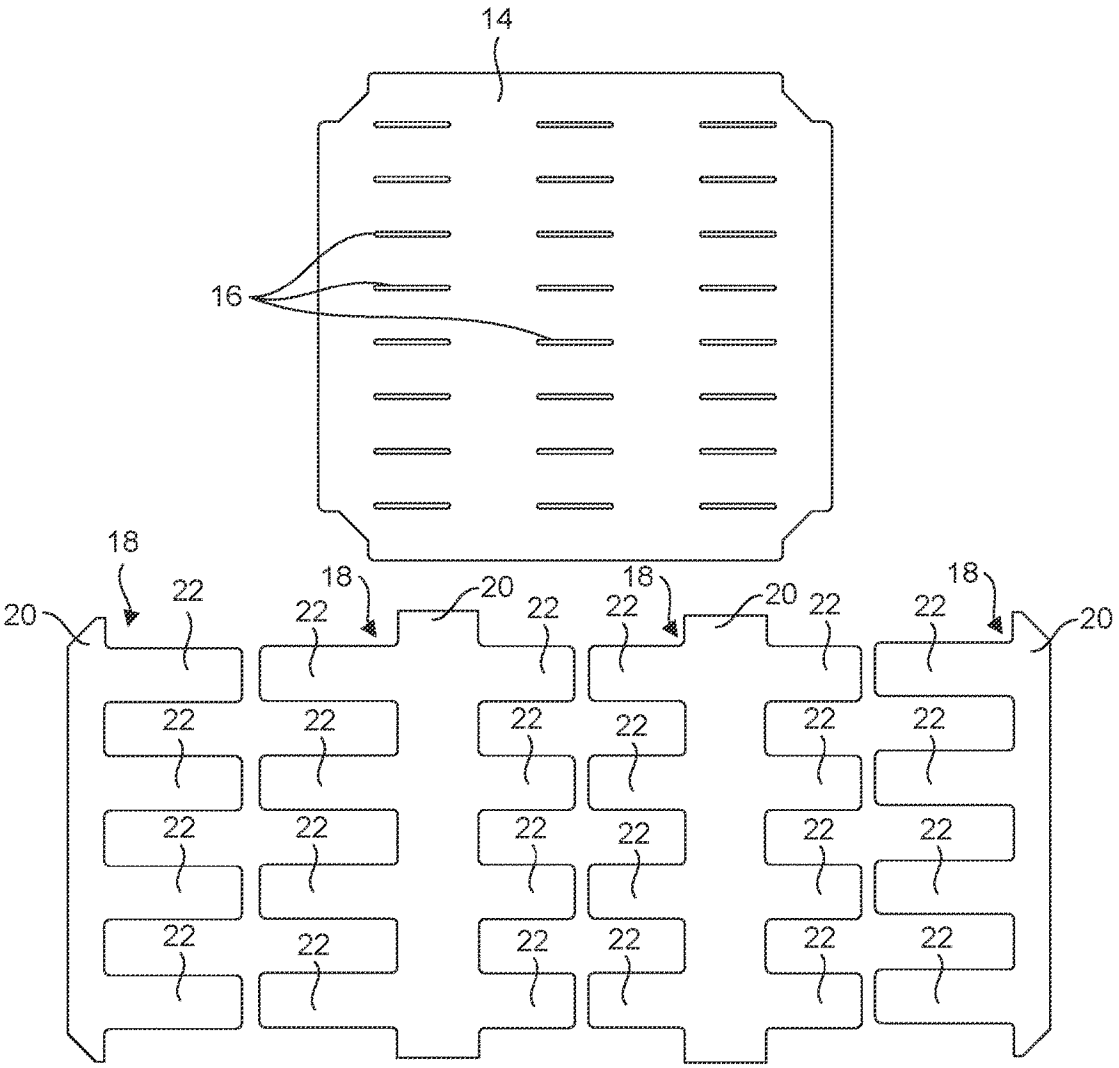
FIG. 1C is a top view of alternative embodiments of a backing panel and fastening patches for a storage apparatus in accordance with an embodiment of the present invention.

As shown in FIGS. 1B and 1C, the backing panel may include slots 16 having the long dimension thereof substantially parallel to the horizontal direction 12*b*. In some embodiments, the length of the slots in the horizontal direction 12*b* may be between 37 mm and 41 mm, such as 39 mm, and the height in the vertical direction 12*a* may be from 2 mm to 3 mm, such as 2.5 mm. As used herein "substantially" with reference to an angle shall be understood to be within 10 degrees of the angle, e.g., within 10 degrees of parallel to the longitudinal direction 12*b*. The slots 16 may be arranged in an array. The spacing between slots 16 in the vertical direction 12*a* may be the same as or different from the spacing between slots 16 in the horizontal direction 12*b*. In some embodiments, the size and arrangement of the slots 16 conforms to the modular lightweight load-carrying equipment (MOLLE) standard and/or the pouch attachment ladder system (PALS) standard.

A plurality of fastening patches 18 secure to the backing panel 14. The fastening patches 18 may be made of fastening material that is part of a hook-and-loop fastening system (e.g., VELCRO), 3M DUAL LOCK, material with snap fasteners secured thereto, or other type of fastening material. In the illustrated embodiment, the fastening patches 18 have fastening properties on both sides thereof. For example, in the orientation of FIG. 1A, surface of fastening material 18 facing the viewer may be loop material whereas the opposite surface includes hook material. However, the opposite arrangement may be used. In another example, both surfaces of the fastening patches 18 are coated with 3M DUAL LOCK material. In some embodiments, the face of the backing panel 14 that faces the patches is also at least partially covered with a fastening material, such as one of those noted above. This facilitates securement of the patches 18 thereto. In some embodiments, the fabric face of the backing panel 14 is a loop (or hook) material of the hook-and-loop fastening system. Additional embodiments with fastener material on the backing panel will be discussed below.

The fastening patches 18 may include a central column 20 with a long dimension and sides therefore substantially parallel to the vertical direction 12*a*. In a MOLLE grid, the size of each span of webbing is 40 mm. In some embodiments, the central column 20 has a width in the horizontal direction 12*b* that is approximately 40 mm, such as between 42 and 38 mm. The height of the central column 20 in the vertical direction 12*a* may be a multiple of the width plus some additional amount, the additional amount being between 50 and 200 mm. The column 20 of each fastening patch 18 may be oriented substantially parallel to the column 20 of the other fastening patches 18.

Each fastening patch 18 may include tabs 22 extending from the column 20. The tab 22 may be arranged in pairs such that each tab 22 secured to a column has a corresponding second tab 22 opposite the column 20 along the horizontal direction 12*b*. Stated differently, one or more of the fastening patches 18 may have tabs 22 arranged such that the one or more fastening patches 18 are symmetrical about an axis of symmetry parallel to the vertical direction 12*a*. The length L of each tab 22 measured along the horizontal direction 12*b* from the nearest edge of the column 20 to which it secures may be greater than or equal to the width of the column 20 along the horizontal direction 12*b*. The length L may also be greater than or equal to the separation between columns 20 of adjacent patches 18 when secured to the backing panel 14. As is apparent in FIG. 1B, the tabs 22 on one side of a column 20 may be longer than those on the opposite side of the column 20. Likewise, some fastening patches 18 may have longer tabs 22 than others. The different lengths may provide for different sizes of loops formed with the tabs 22 to accommodate differently sized items. Note also that strips of fastening material may be secured to a tab 22 to extend its length for further customization.

The height H of the tabs 22 in the vertical direction 12 may be less than or equal to the width of the column 20 in the horizontal direction 12*b* and may be less than or equal to the separation between adjacent tabs 22 in the vertical direction 12*a*. In the illustrated embodiment, the height H is less than both the width of the column 20 and the separation between adjacent tabs. The height H and separation between adjacent tabs 22 in the vertical direction 12*a* may correspond to the standard MOLLE grid spacing. For example, the tabs 22, column 20, and the spacing between tabs 22 may be such that a pair of slots 16 are positioned between each pair of adjacent tabs 22 in the vertical direction 12*a* and between adjacent columns 20 in the horizontal direction 12*b*. Likewise, in some embodiments, at least one slot is positioned above the top tab 22 of each fastening patch 18 and at least one slot is positioned below the bottom tab 22 of each fastening patch.

The leftmost and rightmost fastening patches 18 may include a tabs 22 along only one side of the column 20, though other embodiments include tabs along both sides. As is apparent in FIG. 1B, the upper and lower corners of the columns 20 may be beveled, rounded or otherwise shaped to conform to similar bevels or rounding on the corners of the backing panel 14. The width of the columns 20 of the leftmost and rightmost fastening patches 18 in the horizontal direction 12*b* may also be smaller than that of the other fastening patches 18, such as between 40 and 60 percent of, or between 45 and 55 percent of, the width of the other fastening patches 18.

As is apparent in FIGS. 1B and 1C, there may be various sizes of backing panels 14 with different numbers of fastening patches 18 having different numbers of tabs 22. For example, FIG. 1B shows five fastening patches with three tabs 22 per column 20 edge. FIG. 1C shows four fastening patches with four tabs 22 per column 20 edge.

Referring again to FIG. 1A, the columns 20 of the fastening patches 18 may be fixedly anchored to the backing panel 14 with stitching, such as bar tacks 24. Other fastening means such as adhesives, welding, or the like may also be used. The bar tacks 24 may be positioned on the columns 20 to one or both of (a) provide a gap 26 between the bar tack 24 and a nearest edge of the column 20 along the horizontal direction 12*b* and (b) provide a gap 28 between bar tacks 24 along the vertical direction 12*a*. The gap 28 may also be positioned between tabs 22 secured to the column 20. In the illustrated embodiment, the bar tacks 24 are arranged in pairs that are offset from one another in the horizontal direction 12*b* and substantially aligned (e.g., within 5 mm) with one another along the vertical direction 12*a*. The gap 26 may enable an end of a tab 22 of one fastening patch 18 to be tucked under the column 20 of an adjacent fastening patch 18. The gap 28 may enable straps to be passed under the column 20 and provide an additional means for securing items to the backing panel 14.

In use, one or more tabs 22 from one fastening patch 18 may be secured to one or more tabs 22 on an adjacent fastening patch to form loops under which items 30 may be placed. In some embodiments, long tabs 22, or tabs 22 with additional pieces of fastening material attached thereto, may engage tabs 22 of a non-adjacent fastening patch 18 to secure larger items 30.

Figure 2:
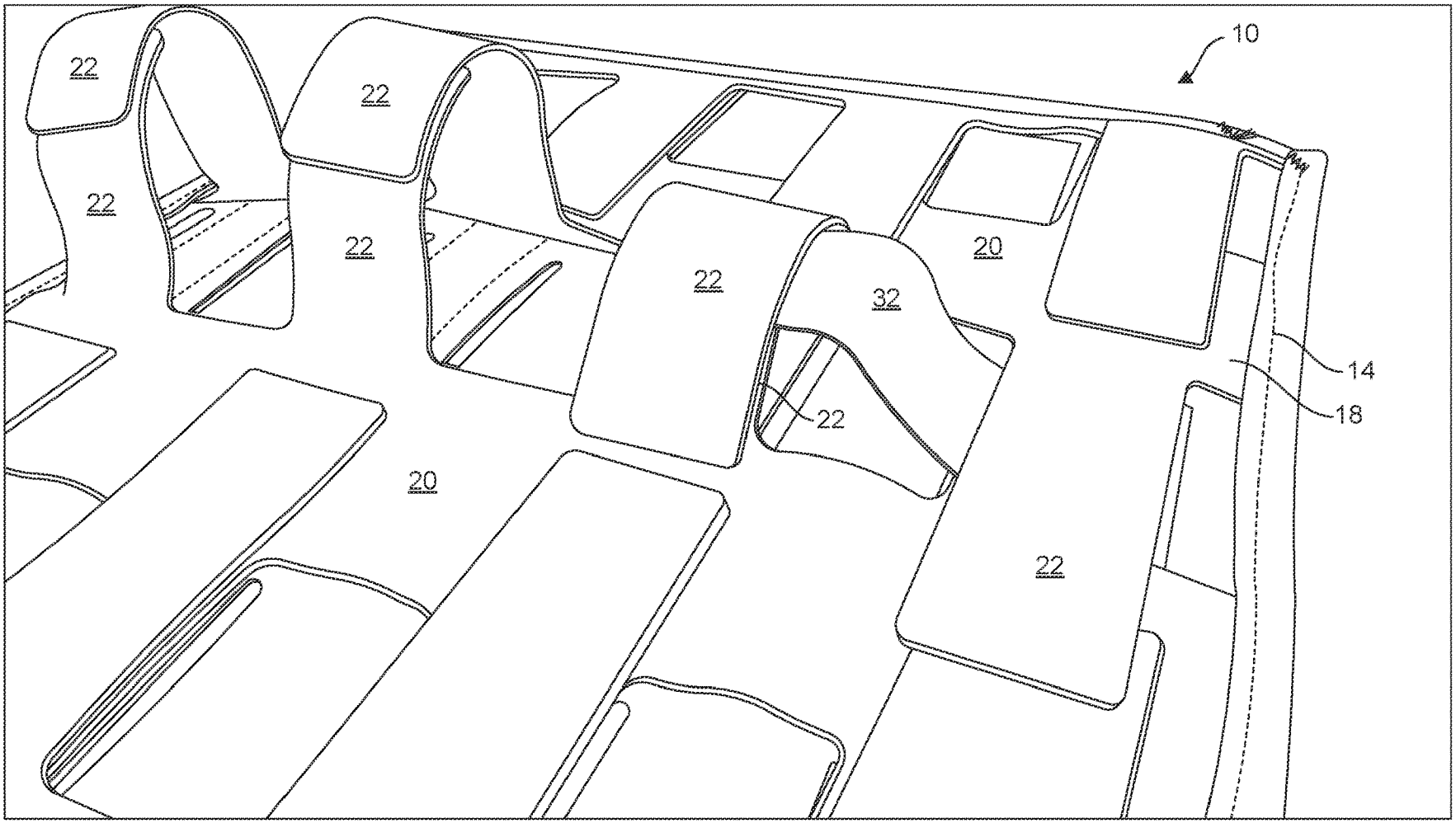
FIG. 2 is an isometric view of the storage apparatus showing the formation of loops for storing items in accordance with an embodiment of the present invention.

Referring to FIG. 2, in one method of use, a first pair of tabs 22 (right most tabs 22 in FIG. 2) are folded over one end of a strip 32 of fastening material in a substantially flat configuration. One or more second pairs of tabs 22 are connected to one another in a more elevated configuration relative to the first pair of tabs 22, leaving a space between the second pairs of tabs 22 and the backing panel 14 for receiving an item. The strip 32 may be secured to the inward facing surface of the inner tab 22 of the first pair of tabs. In this manner, the strip 22 supports an item placed under the one or more second pairs of tabs 22 to prevent the item 30 from sliding out from under one or more second pairs of tabs 22. The strip 32 may be a strip of hook and loop material with hooks on one surface and loops on the other. Alternatively, both surfaces may have 3M DUAL LOCK secured thereto. Alternatively, only one side of the strip 32 includes fastening material. The strip 32, or one of greater length, may also be used to make larger loops by engaging a first tab 22 with one end of the strip 22 and a second tab 22 with the other end of the strip 22 thereby forming a larger loop than the first and second tabs 22 could form when connected directly to one another.

Figure 3:
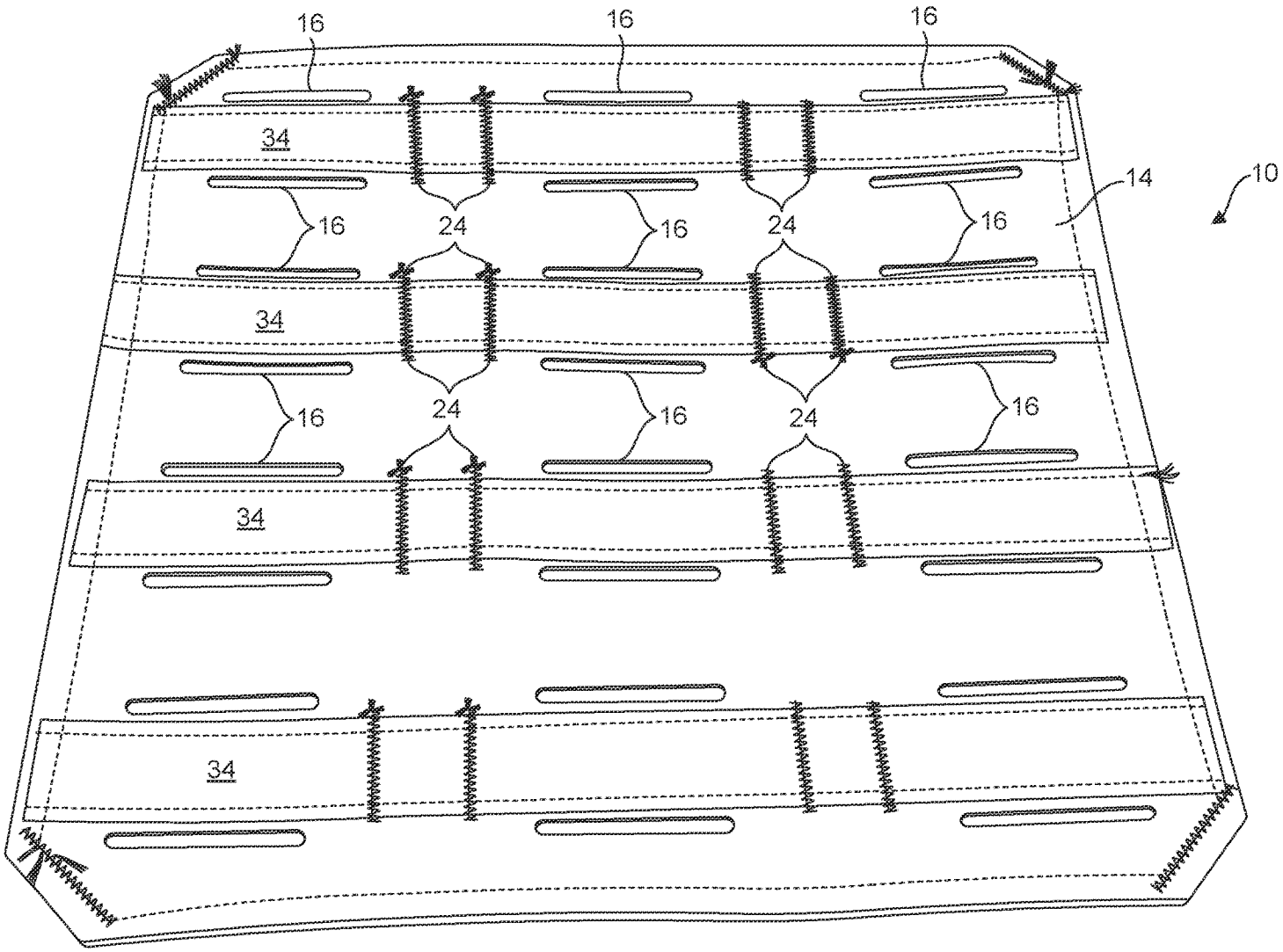
FIG. 3 is an isometric view of a rear surface of a backing panel of a storage apparatus in accordance with an embodiment of the present invention.

Referring to FIG. 3, the backing panel 14 itself may have fastening material 34 secured thereto on one or both sides. In the illustrated embodiment, strips of fastening material 34 extend across the backing panel 14 with the long dimension thereof parallel to the horizontal direction 12*b*. The strips of fastening material may be positioned between pairs of slots 16, such as in every other gap defined by the slots 16 along the vertical direction 12*a*. In the illustrated embodiment, the bar tacks 24 also pass through the fastening material 34. The fastening material 34 may be hook or loop material or 3M DUAL LOCK material. For example, using hooks as the fastening material 34 may be compatible with containers having areas of loop material available.

In other embodiments, the fastening material 34 is single sheet of material extending over substantially all of the back surface of the backing panel 14, such as at least 80 percent or at least 90 percent. The fastening material 34 in such embodiments may have the slots 16 passing therethrough where slots 16 are formed in the backing panel 14. In other embodiments, slots 16 are omitted from the backing panel 14 and the fastening material 34.

Figure 4A:
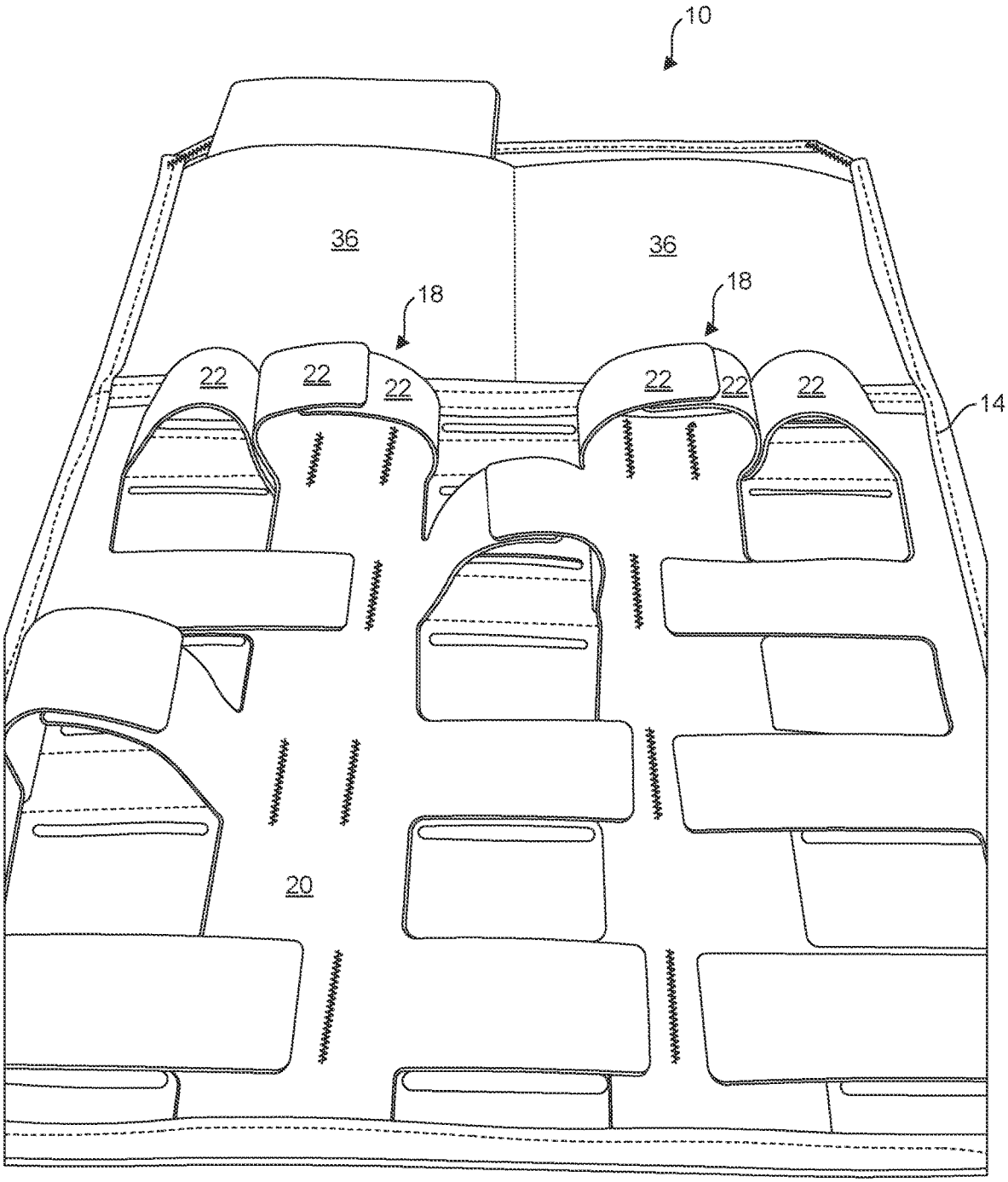
FIG. 4A is an isometric view illustrating an alternative embodiment of a storage apparatus including pockets in accordance with an embodiment of the present invention.
Figure 4B:
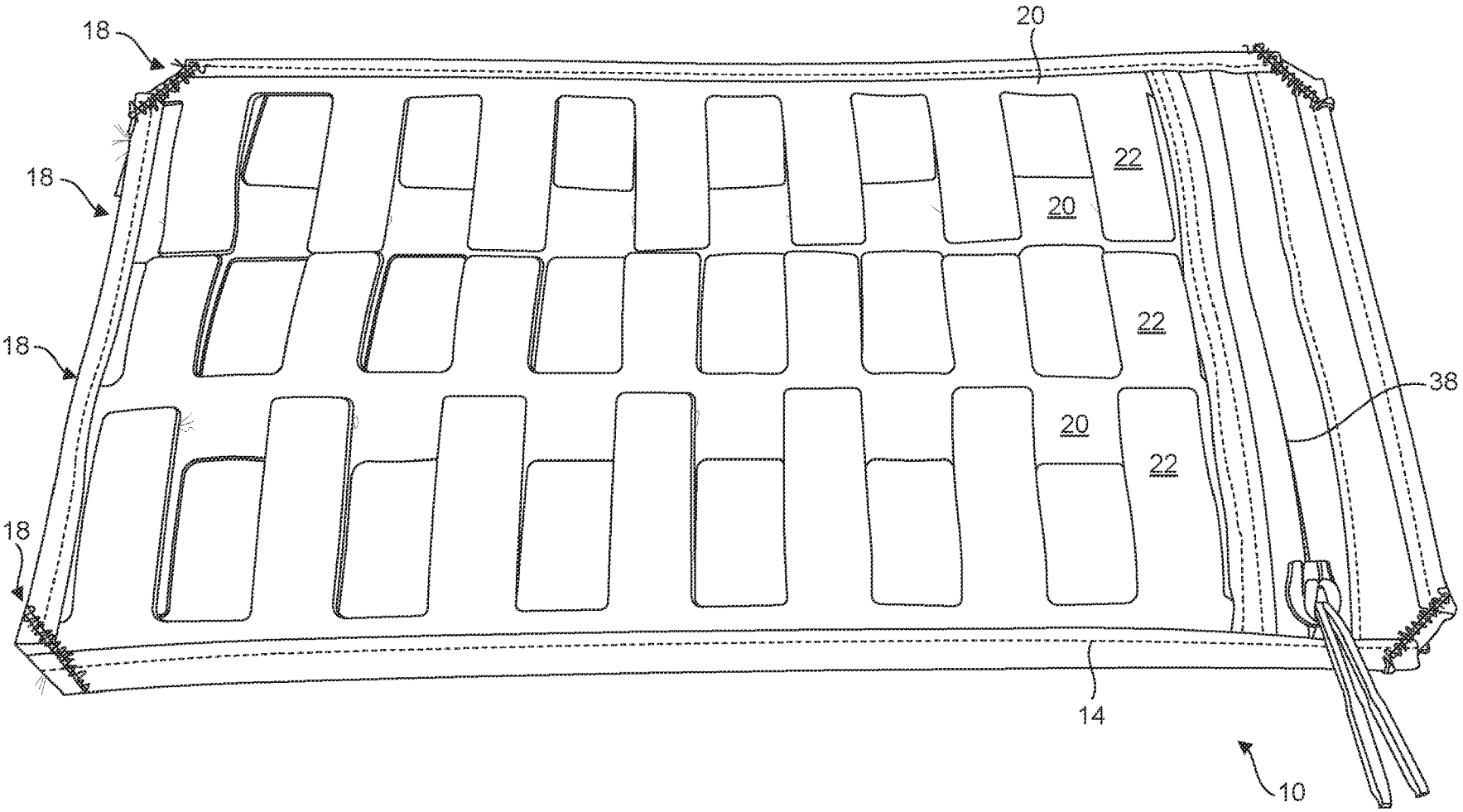
FIG. 4B is an isometric view of a storage apparatus including a backing panel with an integrated pocket in accordance with an embodiment of the present invention.

Referring to FIGS. 4A and 4B, other storage features may be secured to or incorporated in the backing panel 14. As shown in FIG. 4A, one or more pockets 36 are secured to the backing panel 14 such that one part of the backing panel is occupied with pockets 36 and another portion with fastening patches 18 as described above. The pockets 36 may be simple sleeves without closure mechanisms or may include zippers, snaps, or other fasteners for closing the pockets 36. FIG. 4A additionally illustrates an additional use case in which first tabs 22 of the same fastening patch 18 are secured to one another to form a loop. In view of this additional use case, it is apparent that a single fastening patch 18 may be used in some embodiments. A second tab 22 of a second fastening patch may be attached to one of the first tabs 22 of the first fastening patch 18 to form another loop.

In the embodiment of FIG. 4B, a pocket is defined between layers of the backing panel 14 with an opening 38 for accessing the pocket defined near one edge of the backing panel 14. The pocket may therefore be coextensive with the fastening patches 18 secured to the backing panel 14.

FIG. 5 illustrates an example use of the storage apparatus 10. Luggage 40 may include one or more wall panels 42, including side, bottom, and lid panels, that may define a generally cuboid shape. Any of the panels 42 may have fastening material secured thereto that is able to secure to the fastening material 34. For example, where the fastening material 34 is hook material a panel 42 may have loop material fastened thereto. Where the fastening material 34 is 3M DUAL LOCK, a wall panel 42 may likewise have 3M DUAL LOCK secured thereto. The tabs 22 of the storage apparatus 10 may then be connected to one another to form loops for retaining items 30 within the luggage 40. The tabs 22 may form loops of various sizes enabling customization of storage by the user.

Figure 6A:
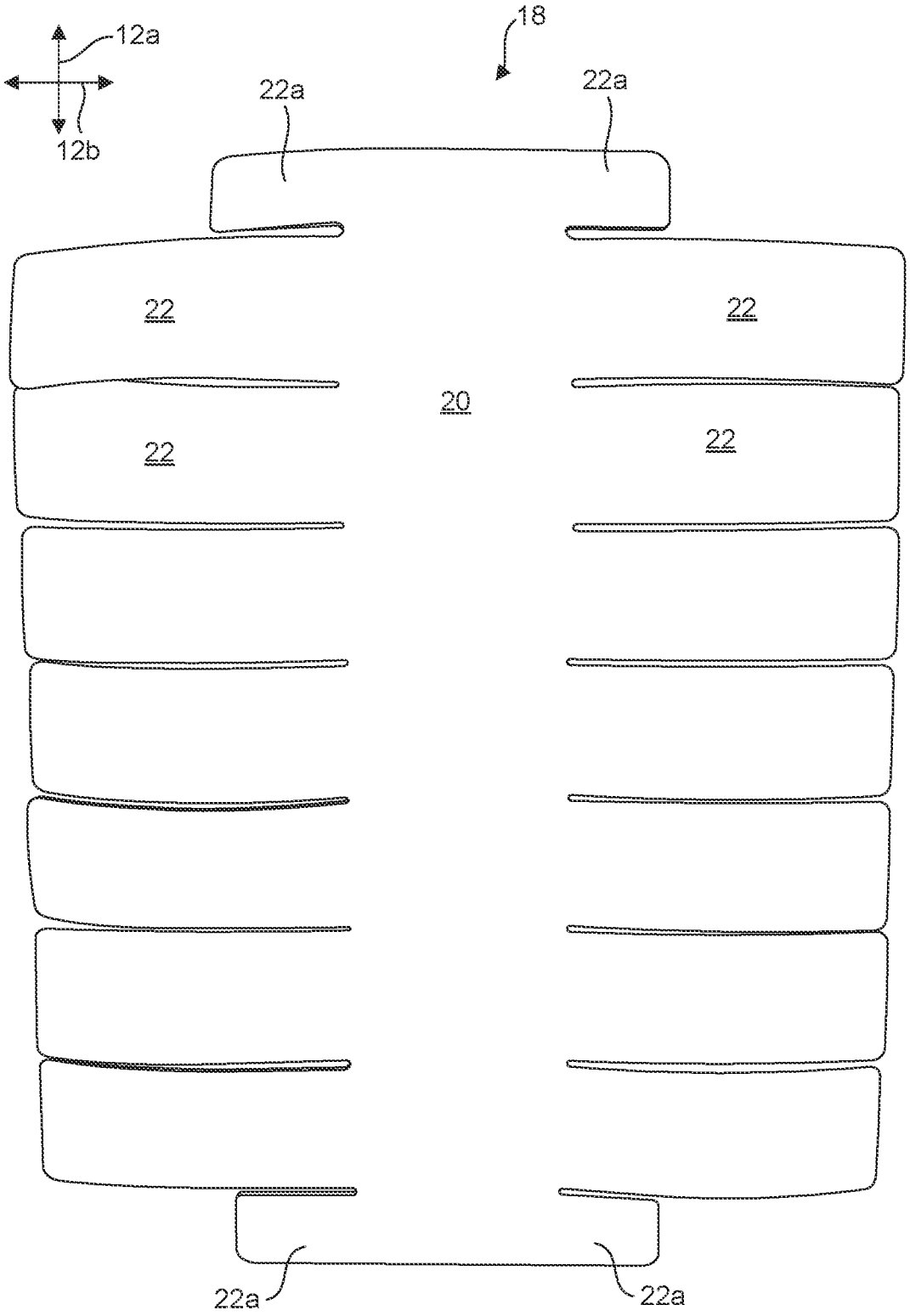
FIG. 6A is a top view of a fastening patch for an alternative implementation of a storage apparatus in accordance with an embodiment of the present invention.
Figure 6B:
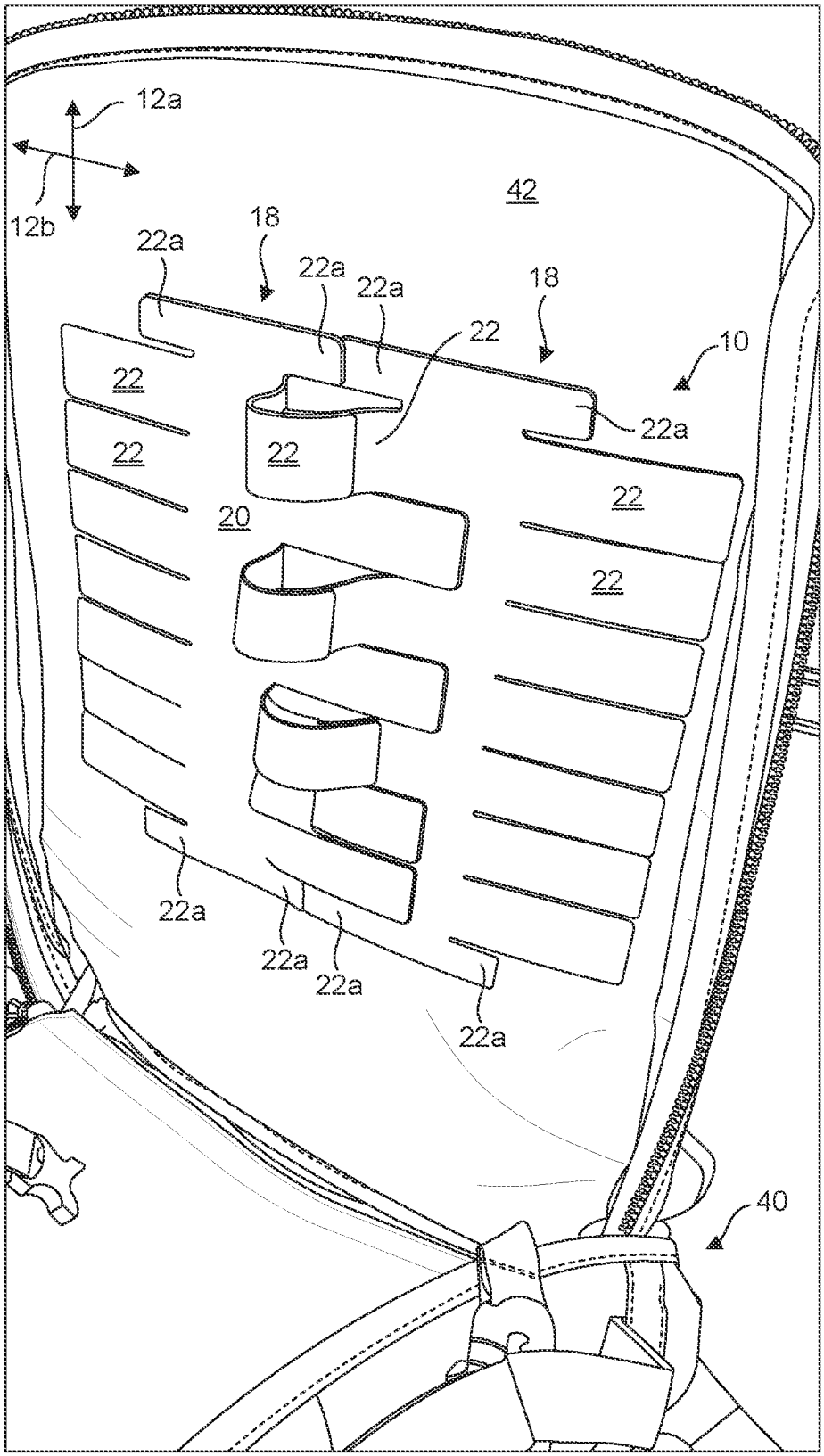
FIG. 6B is an isometric view of an item of luggage incorporating the fastening patch of FIG. 6A in accordance with an embodiment of the present invention.

Referring to FIGS. 6A and 6B, in some embodiments, fastening patches 18 may be configured for use without a backing panel 14 or without being sewn to the backing panel 14. For example, the number of tabs 22 may be increased relative to the fastening patches 18 and the spacing between tabs 22 in the vertical direction 12*a* may be decreased. For example, the spacing between tabs 22 may be from 1 to 5 mm and there may be 7 or more tabs 22. The period of the tabs 22 along the vertical direction may correspond to the MOLLE or PALS standard. For example, the distance from the top edge of a tab 22 to the top edge of an adjacent tab 22 may be about 25 mm, such has from 22 to 28 mm.

Inasmuch as the column 20 is not sewn to a backing panel, anchor tabs 22*a* may be formed at the top and/or bottom of the column 20 to resist removal of the column 20 from a surface to which it is secured. The anchor tabs 22*a* may extend outwardly in the horizontal direction 12*b* from the column 20. The anchor tabs 22*a* may be smaller than the tabs 20 in one or both the vertical direction 12*a* and the horizontal direction 12*b*. In the illustrated embodiment, the tabs 22*a* are smaller in both directions 12*a*, 12*b*. For example, the tabs 22*a* may be between 0.25 and 0.5 times the size of the tabs 22 in both directions 12*a*, 12*b*. The separation between the anchor tabs 22*a* and an adjacent tab 22 may be from 1 to 5 mm in some embodiments.

Referring specifically to FIG. 6B, in use, a surface of a panel 42 of luggage 40 may be formed partially of a fastening material. For example, the fastening material may be loop material or 3M DUAL LOCK material. A pair of fastening patches 18 may be secured to the fastening material of the panel 42, such as by engaging a surface of the fastening patches 18 including hook material or 3M DUAL LOCK material to the fastening material of the panel 42.

As is apparent, the patches 18 may be positioned such that a separation between the columns 20 is less than or equal to the length of the tabs 22 in the horizontal direction 12*b*, such as from 50 to 100 percent of that length. For example, in the illustrated configuration, the anchor tabs 22*a* of the patches 18 abut or overlap one another (e.g., within 1 to 5 mm of one another). Some of the tabs 22 of the patches 18 are secured to one another to form raised loops while other tabs 22 are placed flat with the tab 22 of one patch 18 laid flat over the tab 22 of the other patch 18. In this manner, some tabs 22 provide loops for securing items whereas other tabs 22 serve to anchor the fastening patch 18. In the illustrated embodiment, the flat tabs 22 are arranged such that all of the outer tabs 22 are part of the same patch 18, however other arrangements are also possible. Due to the fastening material on the fastening patches 18, where tabs 22 contact one another they also fasten to one another due to hook-and-loop engagement or 3M DUAL LOCK engagement. Likewise, where the tabs 22 are pressed against the fastening material of the panel 42 they secure thereto. In the illustrated arrangement, a portion of the raised tabs 22 and flat tabs 22 are arranged in an alternating or interleaved manner.

Figure 7:
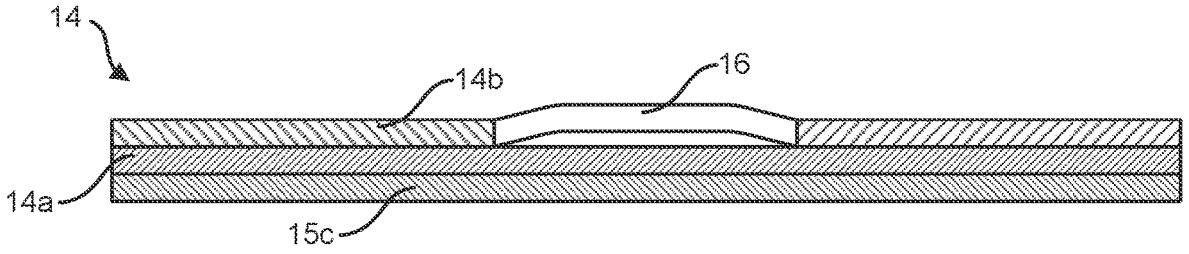
FIG. 7 is a cross sectional view of a backing panel in accordance with an embodiment of the present invention.

FIG. 7 illustrates an example implementation of a backing layer 14. In the illustrated embodiment, the backing layer 14 includes a central layer 14*a* made of a rugged material such as plastic, wood, metal, or heavy-duty woven material. On one side of the central layer 14*a* layer 14*b* of loop material is secured. On the opposite side of the central layer 14*a* a layer 14*c* of hook material is secured. Alternatively, both layers 14*a*, 14*c* are made of 3M DUAL LOCK material. In other embodiments, layer 14*a* is made of hook material and layer 14*c* is made of loop material. In still other embodiment, the central layer 14*a* is omitted. In the illustrated embodiment, the openings 16 (see FIGS. 1B and 1C for distribution of openings 16) only pass through the layer 14*a*. Accordingly, straps may be passed through one opening 16, between portions of the layers 14*a*, 14*c*, and out of another opening 16 in order to secure items to the backing layer 14. The backing layer 14 may additionally have fastening patches 18 secured thereto as in other embodiments described herein.

Figure 8:
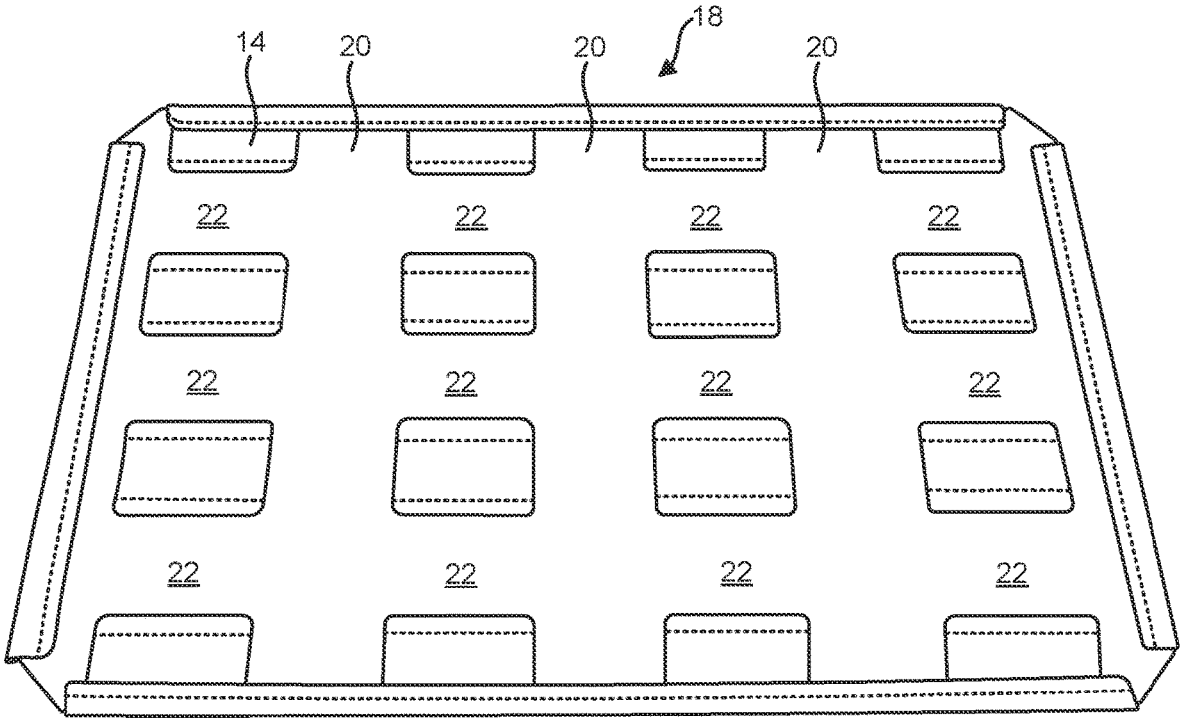
FIG. 8 is an isometric view of an alternative embodiment for a fastening patch in accordance with an embodiment of the present invention.

FIG. 8 illustrates another implementation of a fastening patch 18. In the illustrated embodiment, the fastening patch 18 includes a plurality of columns 22 and tabs 22 that are connected to two adjacent columns 22. For example, the fastening patch 18 of FIG. 8 may be a single piece of material having hooks on one side and loops on the other side. Alternatively, one or both surfaces of the fastening patch 18 may include 3M DUAL LOCK material. In one embodiment, the loops are facing outwardly (toward the viewer in FIG. 8). The illustrated fastening patch 18 may be used by passing straps between the tabs 22 and the backing layer or by securing items to the outward facing surface (e.g., securing hook material to loop material of the fastening patch 18)

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A storage system comprising:

two or more fastening patches each comprising a sheet of material having a first surface and a second surface opposite the first surface, the first surface having a first fastening material and the second surface having a second fastening material configured to selectively secure to the first fastening material;

wherein each fastening patch of the two or more fastening patches defines a first direction and a second direction perpendicular to the first direction and comprises:

a column having a long dimension substantially parallel to the first direction; and tabs extending outwardly from the column in the second direction by an amount at least as great as a width of the column in the second direction;

wherein the first surface having the first fastening material secured thereto extends over the tabs and the column;

wherein the second surface having the second fastening material secured thereto extends over the tabs and the column, and wherein the tabs include a first tab on a first fastening patch and a second tab on a second fastening patch, the second tab being aligned with the first tab in the first direction for selectively engaging with the first tab at multiple positions along the second direction.

2. The storage system of claim 1, wherein the one or more fastening patches comprise three or more fastening patches.

3. The storage system of claim 1, wherein:

the two or more fastening patches comprise three or more fastening patches including one or more first fastening patches and two second fastening patches, the one or more first fastening patches being positioned between the two second fastening patches;

the tabs of each of the one or more first fastening patches extend outwardly from both a first edge and a second edge of the column of each of the one or more first fastening patches;

the tabs of a left fastening patch of the two second fastening patches extend only from a second edge of the column of the left fastening patch facing the one or more first fastening patches; and the tabs of a right fastening patch of the two second fastening patches extend only from a first edge of the column of the left fastening patch facing the one or more first fastening patches.

4. The storage system of claim 3, further comprising:

a backing layer, the three or more fastening patches being secured to the backing layer having the columns thereof substantially parallel to one another and positioned such that the tabs of each fastening patch of the three or more fastening patches can be connected to the tabs of one or two other fastening patches of the three or more fastening patches.

5. The storage system of claim 4, wherein the one or more first fastening patches are secured to the backing layer between the two second fastening patches.

6. The storage system of claim 4, wherein the three or more fastening patches are secured to the backing layer by stitching that is offset inwardly from first and second edges of the columns of the one or more first fastening patches and the first edges of the columns of the two second fastening patches.

7. The storage system of claim 6, wherein the stitching includes bar tacks that are offset from one another along the first direction and are not positioned between the tabs of the three or more fastening patches along the first direction.

8. The storage system of claim 4, wherein lengths of the tabs of the three or more fastening patches are greater than a separation between the columns of the three or more fastening patches.

9. The storage system of claim 4, wherein positions of the tabs on the backing layer conform to either of the modular lightweight load-carrying equipment (MOLLE) standard and the pouch attachment ladder system (PALS) standard.

10. The storage system of claim 4, wherein the three or more fastening patches are secured to a first side of the backing layer and third fastening material is secured to a second side of the backing layer opposite the first side.

11. The storage system of claim 1, wherein the first fastening material and second fastening material are either of (a) part of a hook-and-loop fastening system or (b) 3M DUAL LOCK fastening material.

12. The storage system of claim 11, wherein:

the tabs of each fastening patch of the two or more fastening patches are first tabs; and each fastening patch of the two or more fastening patches includes upper anchor tabs extending outwardly from the column in the second direction and lower anchor tabs extending outwardly from the column in the second direction having the first tabs positioned between the upper anchor tabs and the lower anchor tabs along the first direction.

13. The storage system of claim 12, wherein separation between adjacent tabs of the first tabs, upper anchor tabs, and lower anchor tabs along the first direction is between 1 and 5 mm.

14. The storage system of claim 12, wherein the upper anchor tabs and lower anchor tabs are smaller than the first tabs in one or both of the first direction and the second direction.

15. The storage system of claim 12, wherein the upper anchor tabs and lower anchor tabs are smaller than the first tabs in both of the first direction and the second direction.

16. A method comprising:

providing a storage system comprising:

at least two fastening patches each comprising a sheet of material having a first surface and a second surface opposite the first surface, the first surface having a first fastening material and the second surface having a second fastening material configured to selectively secure to the first fastening material;

wherein each fastening patch of the at least two fastening patches defines a first direction and a second direction transverse to the first direction and comprises:

a column having a long dimension substantially parallel to the first direction; and tabs extending outwardly from the column in the second direction by an amount at least as great as a width of the column in the second direction;

connecting a first tab of the tabs of a first fastening patch of the at least two fastening patches to a second tab of the tabs of a second fastening patch of the at least two fastening patches to form a loop around an item to secure the item in place;

wherein the first surface having the first fastening material secured thereto extends over the tabs and the column; and wherein the second surface having the second fastening material secured thereto extends over the tabs and the column.

17. The method of claim 16, wherein the at least two fastening patches are secured to a backing layer.

18. The method of claim 17, wherein the at least two fastening patches are secured to the backing layer by stitching.

19. The method of claim 18, wherein the at least two fastening patches are secured to the backing layer by either hook-and-loop fastening material or 3M DUAL LOCK material.

20. The method of claim 18, further comprising securing the backing layer to a panel of an item of luggage by either hook-and-loop fastening material or 3M DUAL LOCK material.

* * * * *